US011118410B2

(12) United States Patent
Gerhardt et al.

(10) Patent No.: US 11,118,410 B2
(45) Date of Patent: Sep. 14, 2021

(54) DEVICE FOR PRODUCING A CAVITY IN A SOIL

(71) Applicant: HERRENKNECHT AG, Schwanau (DE)

(72) Inventors: Tobias Gerhardt, Teningen (DE); Marc Peters, Freiburg (DE); Steffen Praetorius, Schwanau (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 16/348,852

(22) PCT Filed: Jul. 12, 2017

(86) PCT No.: PCT/EP2017/067647
§ 371 (c)(1),
(2) Date: May 9, 2019

(87) PCT Pub. No.: WO2018/015258
PCT Pub. Date: Jan. 25, 2018

(65) Prior Publication Data

US 2019/0284879 A1 Sep. 19, 2019

(30) Foreign Application Priority Data

Jul. 21, 2016 (DE) ..... 10 2016 008 762.5

(51) Int. Cl.
*E21B 10/60* (2006.01)
*E21B 10/61* (2006.01)
(Continued)

(52) U.S. Cl.
CPC ..... *E21B 10/60* (2013.01); *E21B 7/18* (2013.01); *E21B 7/20* (2013.01); *E21B 10/61* (2013.01); *E21D 9/06* (2013.01)

(58) Field of Classification Search
CPC . E21B 7/18; E21B 7/20; E21B 10/605; E21B 10/61; E21C 37/12; E21C 37/14
See application file for complete search history.

(56) References Cited

U.S. PATENT DOCUMENTS 1,853,379 A * 4/1932 Rotinoff ..... E02D 5/32
405/8
3,938,600 A * 2/1976 Essmeier ..... E02D 7/24
175/424
6,250,566 B1 * 6/2001 Jager ..... B05B 1/1636
239/237

FOREIGN PATENT DOCUMENTS

DE 3047161 A1 6/1982
DE 4217293 C2 4/1996
(Continued)

*Primary Examiner* — Cathleen R Hutchins
(74) *Attorney, Agent, or Firm* — Mark Rodgers

(57) ABSTRACT

The invention relates to a device (10) for producing a cavity in a soil from a starting point to a target point along a drilling line for introducing timbering for holding the cavity open having a tunneling head (11), at the outer end of which at least one cutting element (12) for Stripping the soil is provided, wherein the tunneling head (11) has a receiving Chamber (15) which has an opening (16), to which a face conveyor line (17) is connected, and in which at least a first nozzle (21) for discharging a liquid for transporting the stripped soil away from the receiving Chamber is provided, which first nozzle (21) is provided in such a way that the discharge opening thereof is oriented substantially in the direction of the face conveyor line, wherein the advancing drive takes place via an advancing device. It is provided here that at least one second nozzle (23) is provided which is arranged in such a way that the discharge opening thereof is directed substantially onto the soil to be stripped.

20 Claims, 12 Drawing Sheets

Figure 1A:
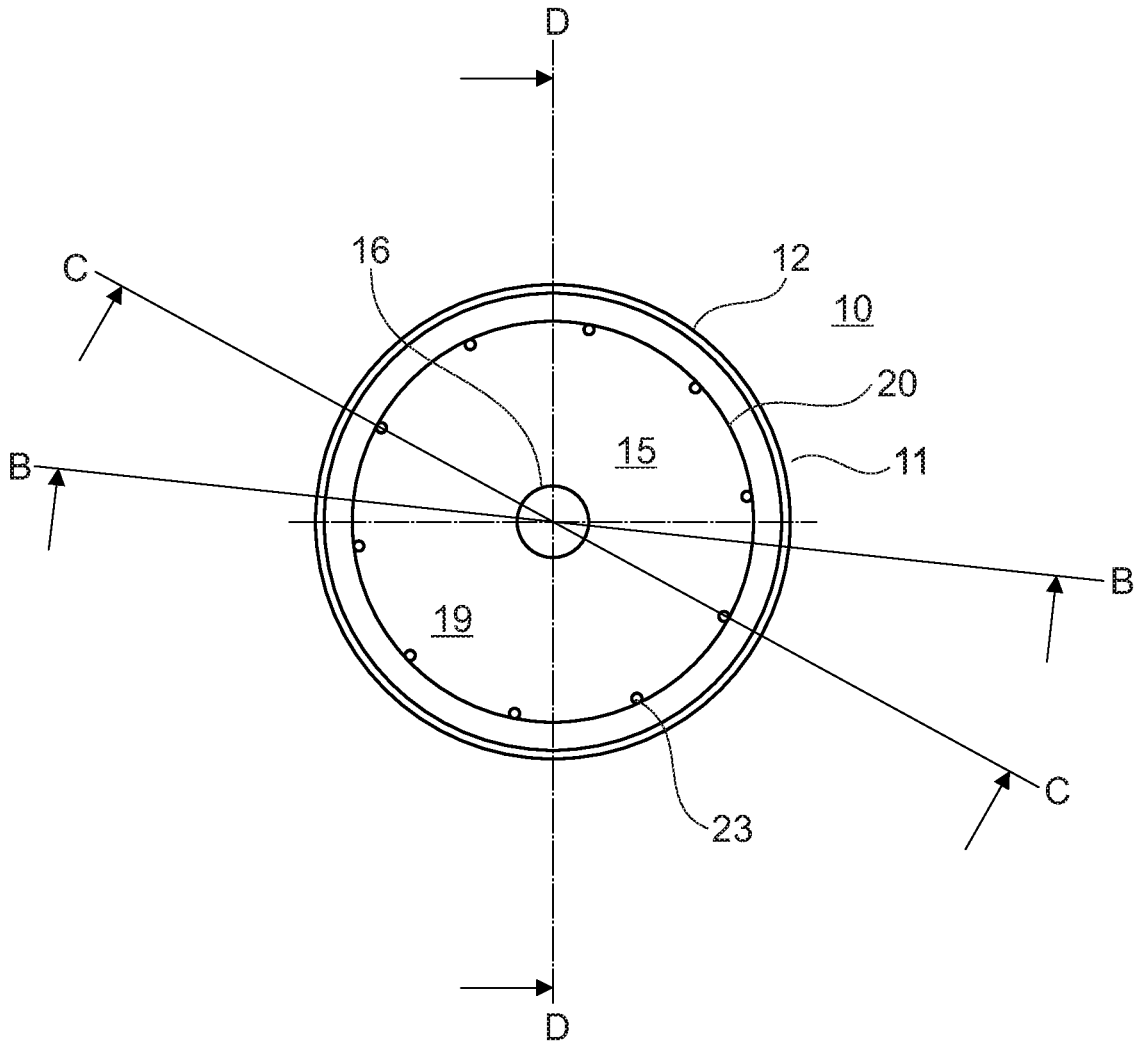

(51) Int. Cl.

| | |
|---|---|
| ***E21B 7/18*** | (2006.01) |
| ***E21B 7/20*** | (2006.01) |
| ***E21D 9/06*** | (2006.01) |

(56) References Cited

FOREIGN PATENT DOCUMENTS

| | | | |
|---|---|---|---|
| FR | 1338375 | A | 9/1963 |
| JP | 54144741 | A | 11/1979 |
| JP | 55585799 | A | 6/1980 |
| JP | 2006-348639 | A | 12/2006 |
| WO | 1996027067 | A1 | 9/1996 |

* cited by examiner

DEVICE FOR PRODUCING A CAVITY IN A SOIL

The invention relates to an apparatus for creating a cavity in the ground from a starting point to a target point along a boring line for the introduction of a support system for keeping the cavity open, having a driving head, at the outer end of which at least one cutting element for breaking up the ground is provided, wherein the driving head has a receiving space that has an opening to which a discharging line is connected, and at least one first nozzle for delivering a liquid for transporting away the broken-up ground from the receiving space being provided in said driving head, said nozzle being provided such that the delivery opening thereof is oriented substantially in the direction of the discharging line, wherein driving takes place via an advancing device.

An apparatus of this kind is known from DE 4 217 293 C2. In that document, stoneware pipes are introduced into the ground via a press frame from a starting pit. Arranged ahead of the stoneware pipes is a driving head, which has at its outer end a cutting tool for breaking up the ground. The driving head has a receiving space for the ground broken up via the cutter. Arranged in this receiving space is a rotary nozzle that delivers liquid in the form of a jet, wherein the nozzles are oriented away from the cutter in the direction of the stoneware pipes. The ground passing into the receiving space is struck by the liquid jets and moved through the stoneware pipes in the direction of the starting pit. Depending on the cohesion of the ground to be broken up, the head with the nozzles is moved closer to the cutter (cohesive ground) or arranged away from this side (sandy ground).

A drawback here, in particular in the case of very cohesive ground, is that the driving head shown therein can become clogged or the ground is broken up in a plug-like manner by the cutter without reaching the jet region as such at all, with the result that the plug is not broken up and thus clogging can occur.

Therefore, it is an object of the invention to overcome the abovementioned drawbacks.

This object is achieved in that at least one second nozzle is provided, which is arranged such that the delivery opening thereof is directed substantially toward the ground to be broken up.

This has the advantage that the ground is already reduced to small pieces while it is being broken up, and is mixed with the liquid, thereby ensuring better discharging and avoiding clogging. A further advantage, in particular for relatively large diameters >600 mm, is that the boring head or the boring pipes do not have to be rotated. As a result, the required technology such as press frames etc. can be dispensed with more easily.

In a further teaching of the invention, at least one third nozzle is provided, which is arranged such that the delivery opening thereof is directed substantially toward an opposite wall of the receiving space. As a result, the reduction to small pieces and breaking up of the ground is improved further.

In a further teaching of the invention, the at least one first, the at least one second and/or the at least one third nozzle are selectable separately. As a result, the use of liquid can be adapted optimally to the ground conditions.

In a further teaching of the invention, the support system consists of jacking pipes, tunnel segments, pipe segments or pipelines.

In a further teaching of the invention, the at least one nozzle is a full jet nozzle. This is understood to be a nozzle that delivers a focused jet that strikes an obstacle substantially as a point jet. In this case, the energy is output optimally in the form of a point. This is advantageous when relatively large objects are intended to be reduced to small pieces in a targeted manner or are intended to be moved away.

In a further teaching of the invention, the at least one first nozzle is embodied as a full jet nozzle. This is advantageous when relatively large objects are intended to be reduced to small pieces in a targeted manner in the rear region of the receiving space of the driving head or are intended to be moved away.

In a further teaching of the invention, at least one nozzle is a flat jet nozzle. In a further teaching of the invention, the at least one second and/or the at least one third nozzle is embodied as a flat jet nozzle. This is understood as being a nozzle that delivers a jet that fans out at least in one direction, with the result that a broader cutting action takes place at the sprayed object. The point energy of the jet becomes lower, with the result that the penetration depth into the ground is reduced, but at the same time more extensive reduction into small pieces is effected.

In a further teaching of the invention, the receiving space is embodied in a conical manner. Alternatively, other shapes can also be provided. The cone is suitable in particular when the broken-up ground can be discharged via gravity.

In a further teaching of the invention, the receiving space has in its wall a portion in which the nozzles are arranged. As a result, it is possible to provide in one region a plurality of nozzles with different orientations.

In a further teaching of the invention, at least two nozzles are provided, which are oriented in the direction of the opening, of the wall and/or of the ground. As a result, the reduction into small pieces and discharging of the broken-up ground is improved.

In a further teaching of the invention, the liquid jets delivered by the nozzles intersect at a point. As a result, the reduction into small pieces and discharging of the broken-up ground is imp roved. Furthermore, the energy of the liquid jets is focused in a point.

In a further teaching of the invention, the first nozzle is arranged such that the delivered liquid jet is delivered substantially parallel to the surface of the receiving space. As a result, the cleaning and transport action of the broken-up ground with respect to the wall is improved.

Figure 1B:
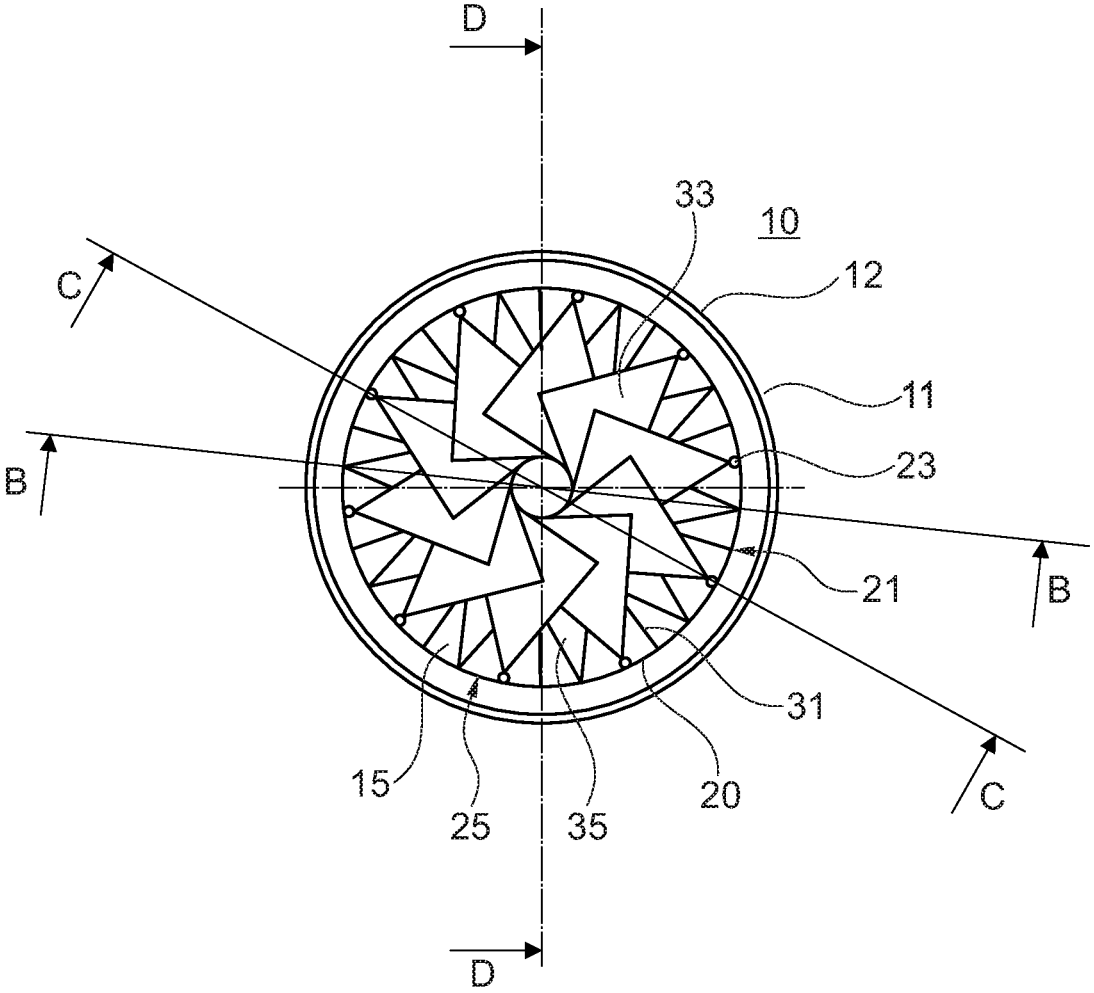
Figure 2A:
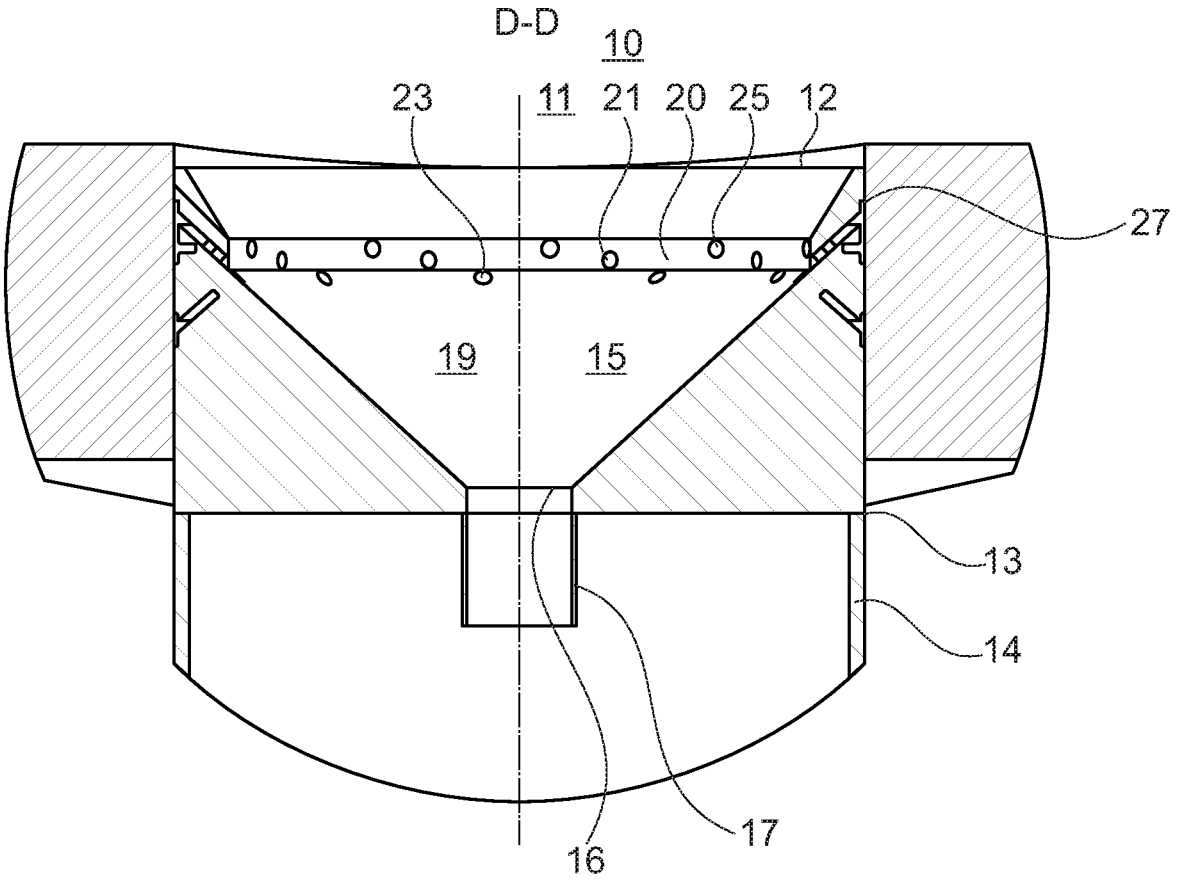
Figure 2B:
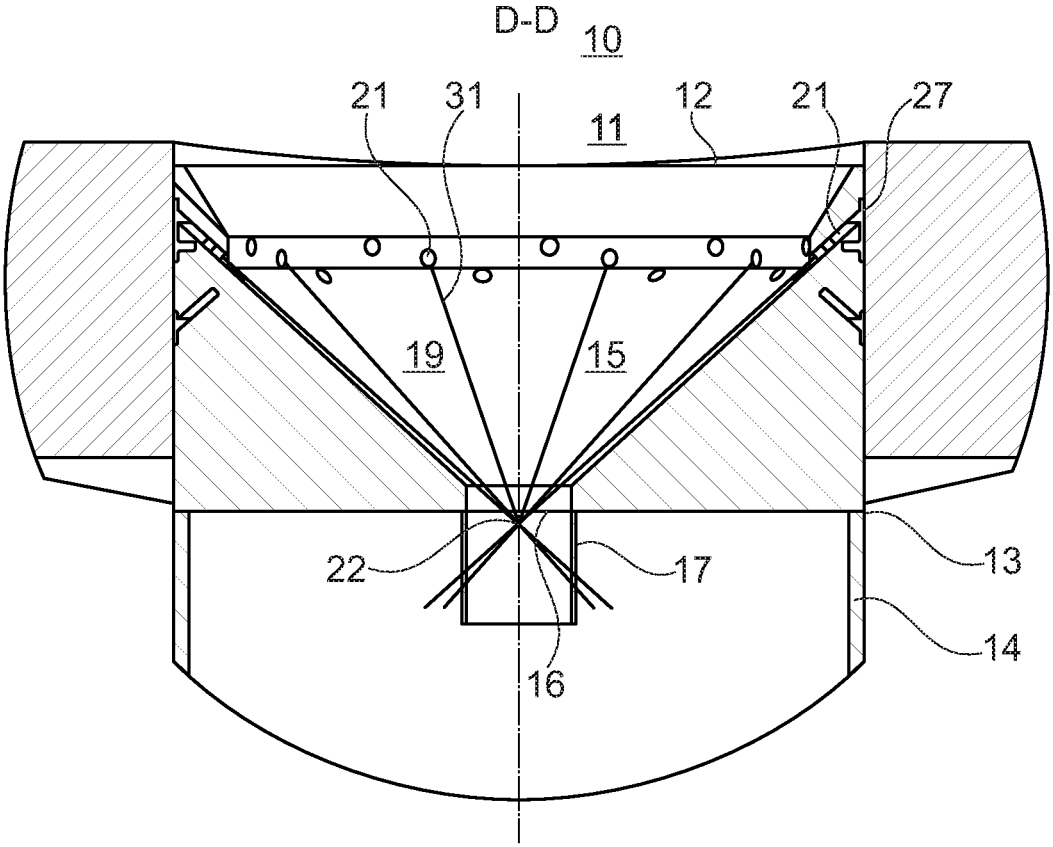
Figure 2C:
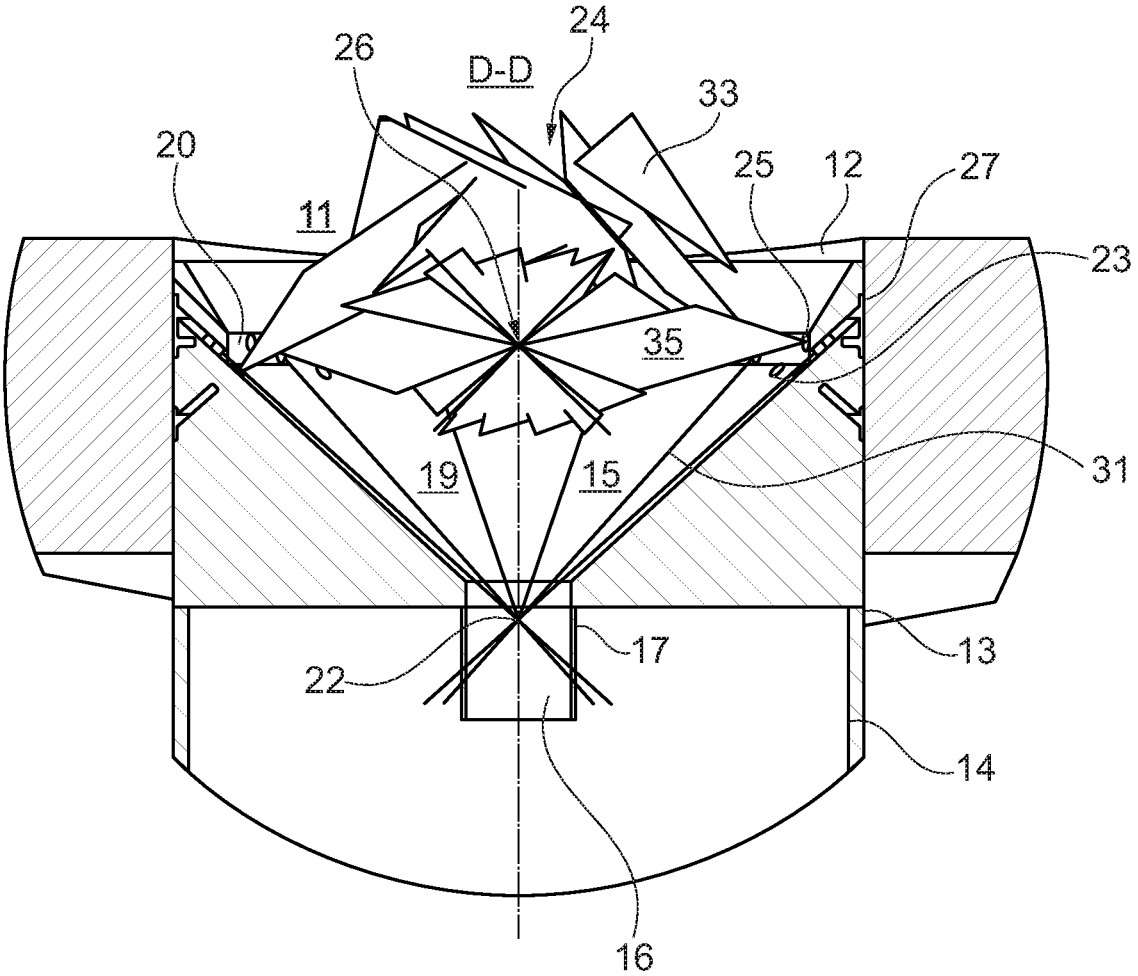
Figure 3A:
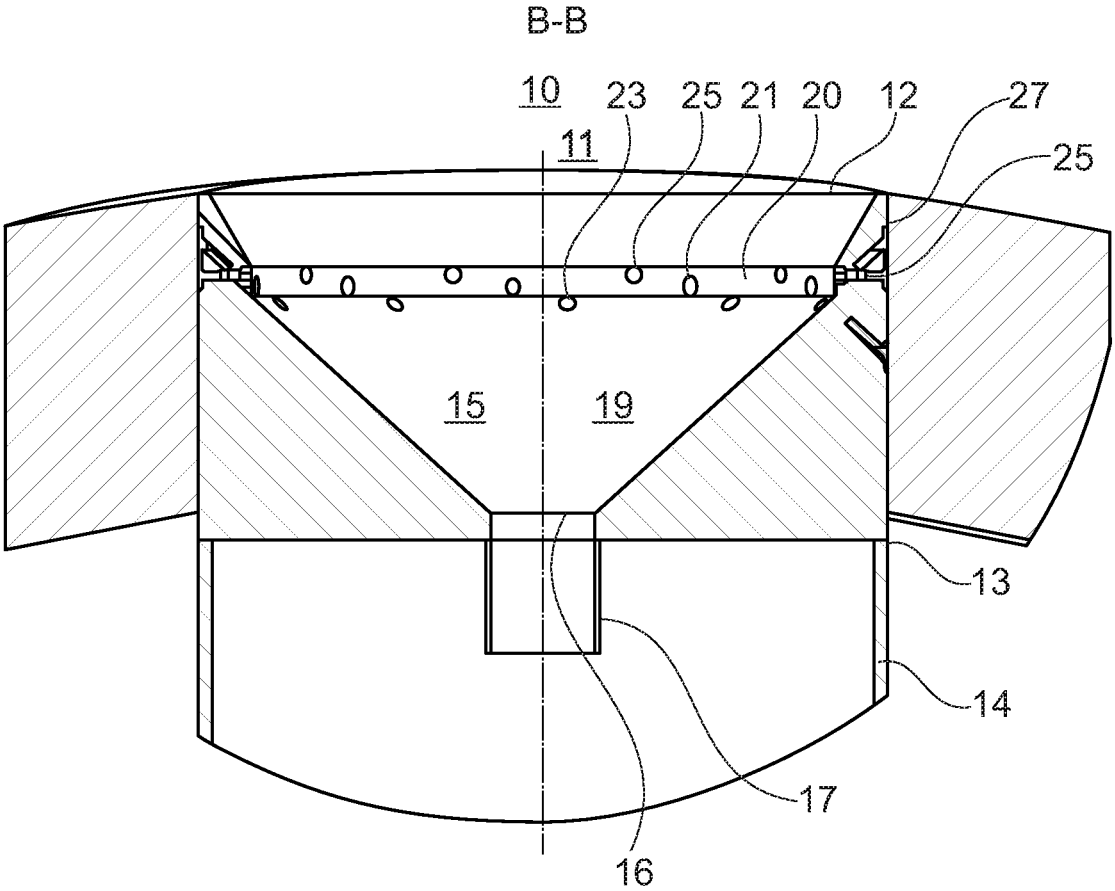
Figure 3B:
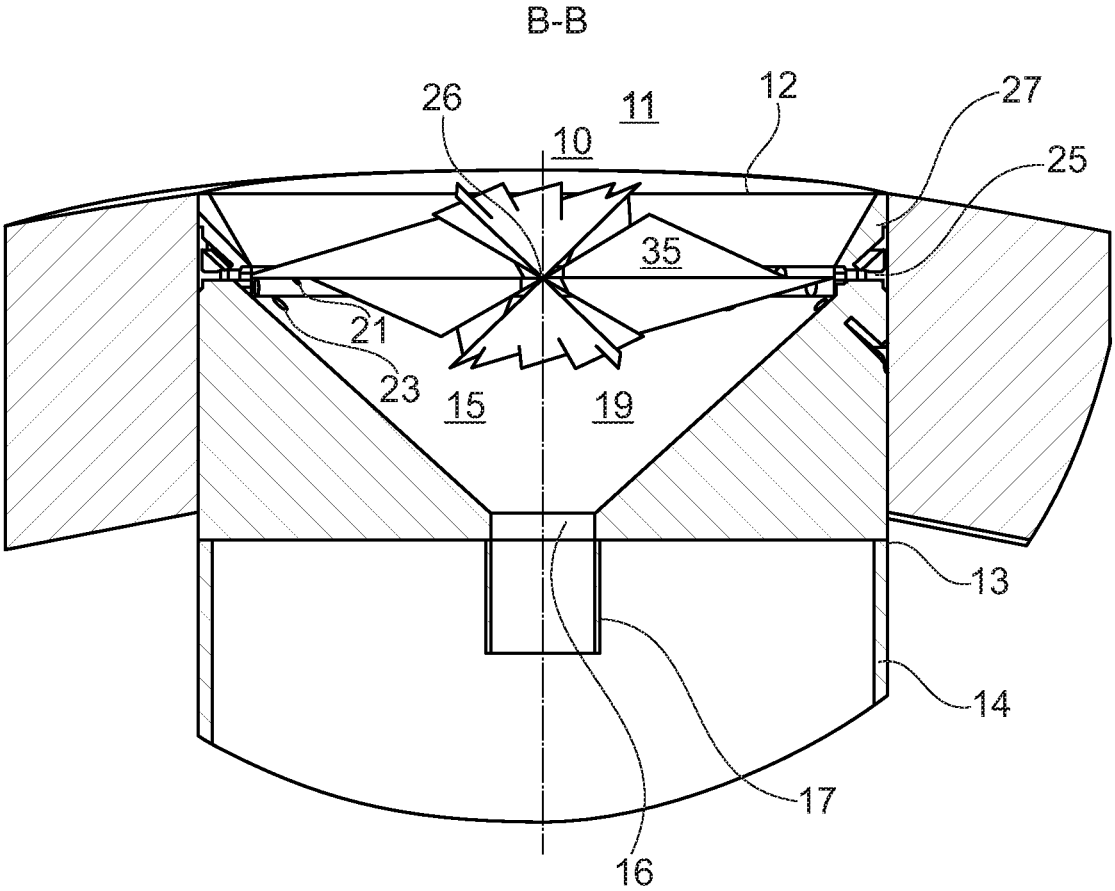
Figure 3C:
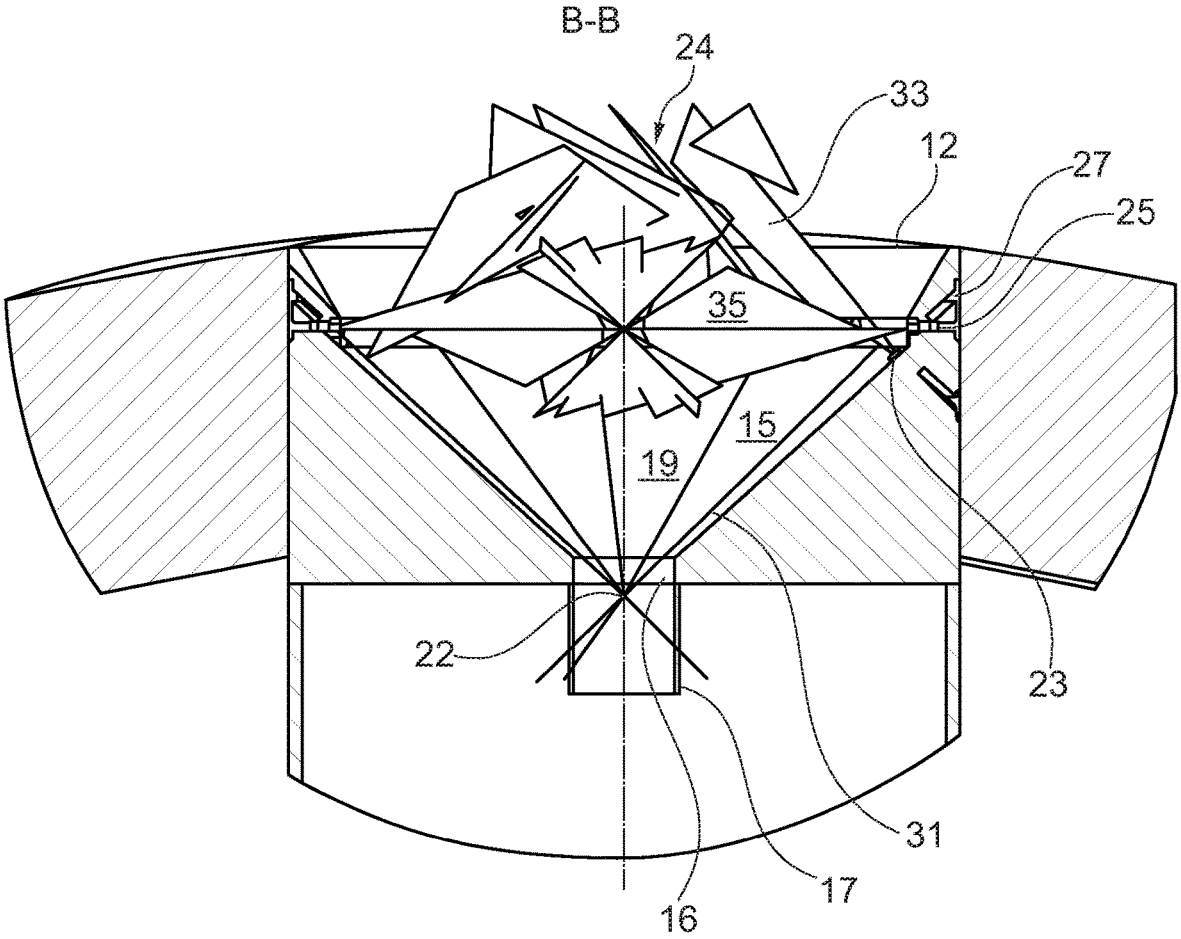
Figure 4A:
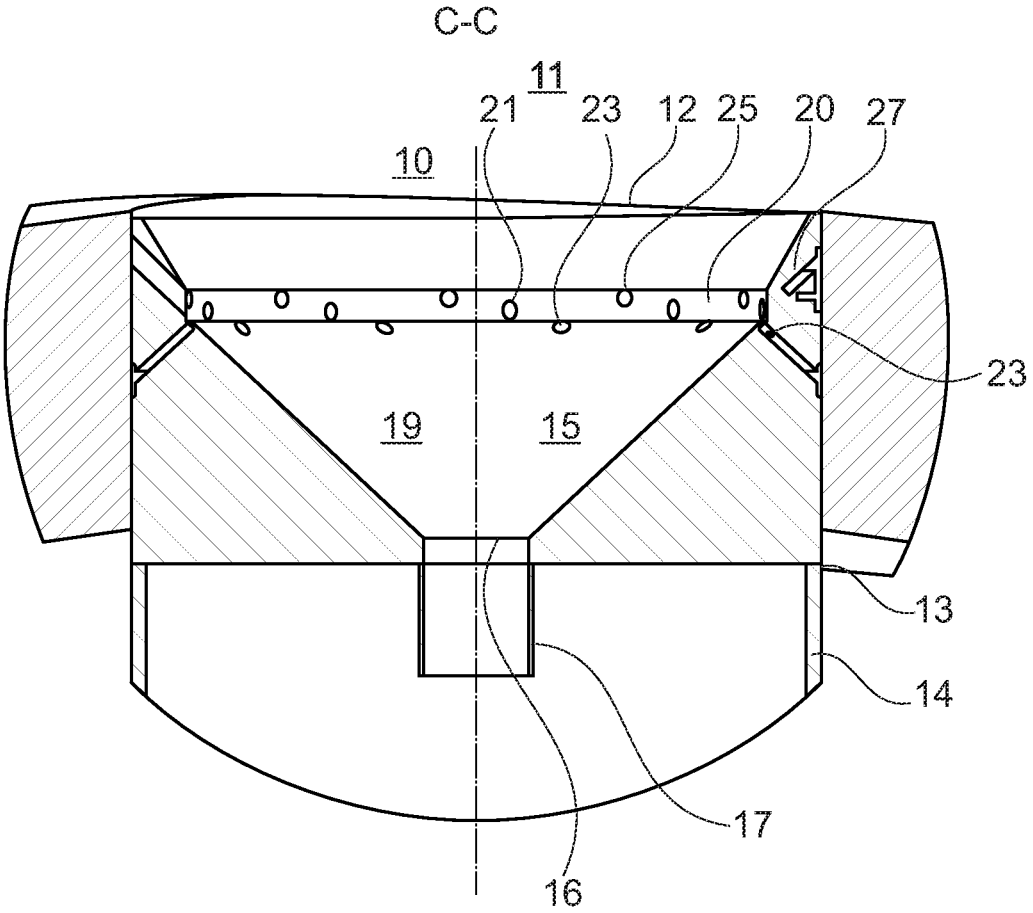
Figure 4B:
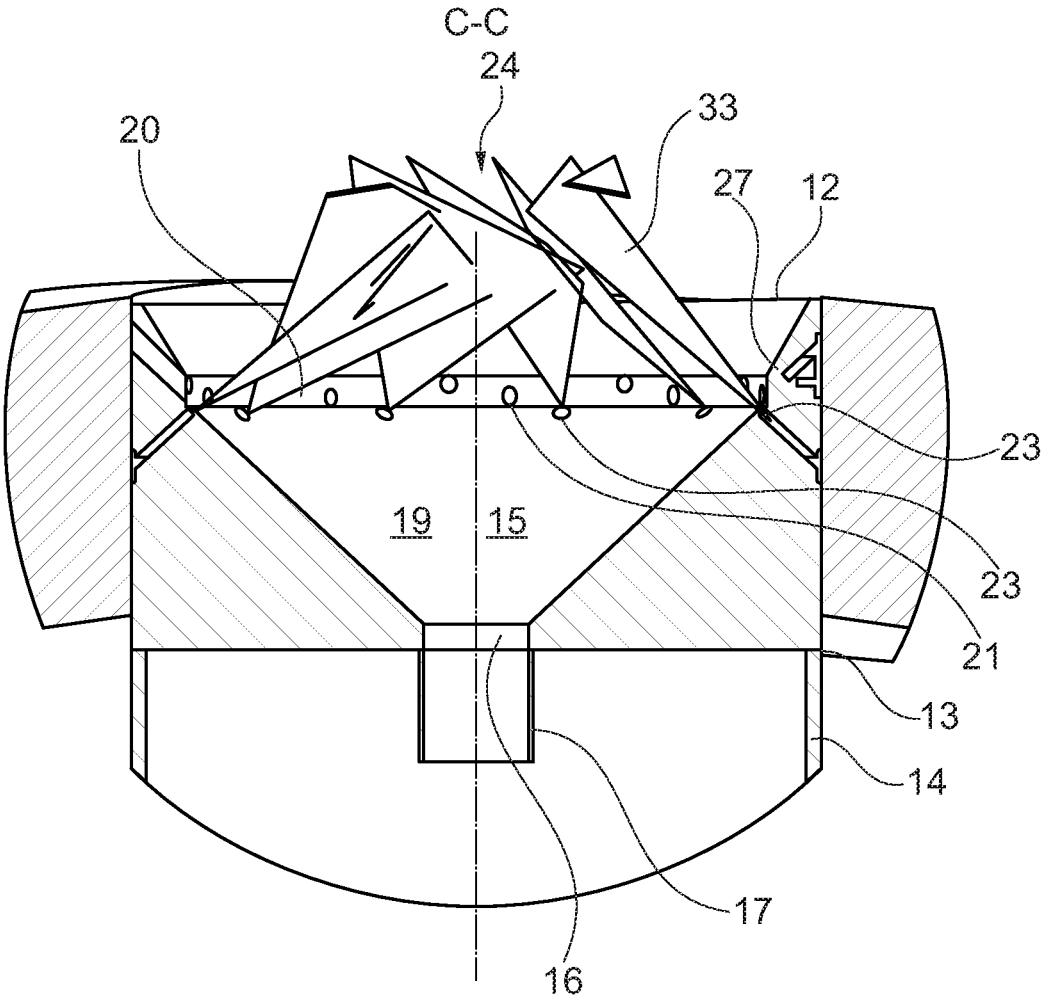
Figure 4C:
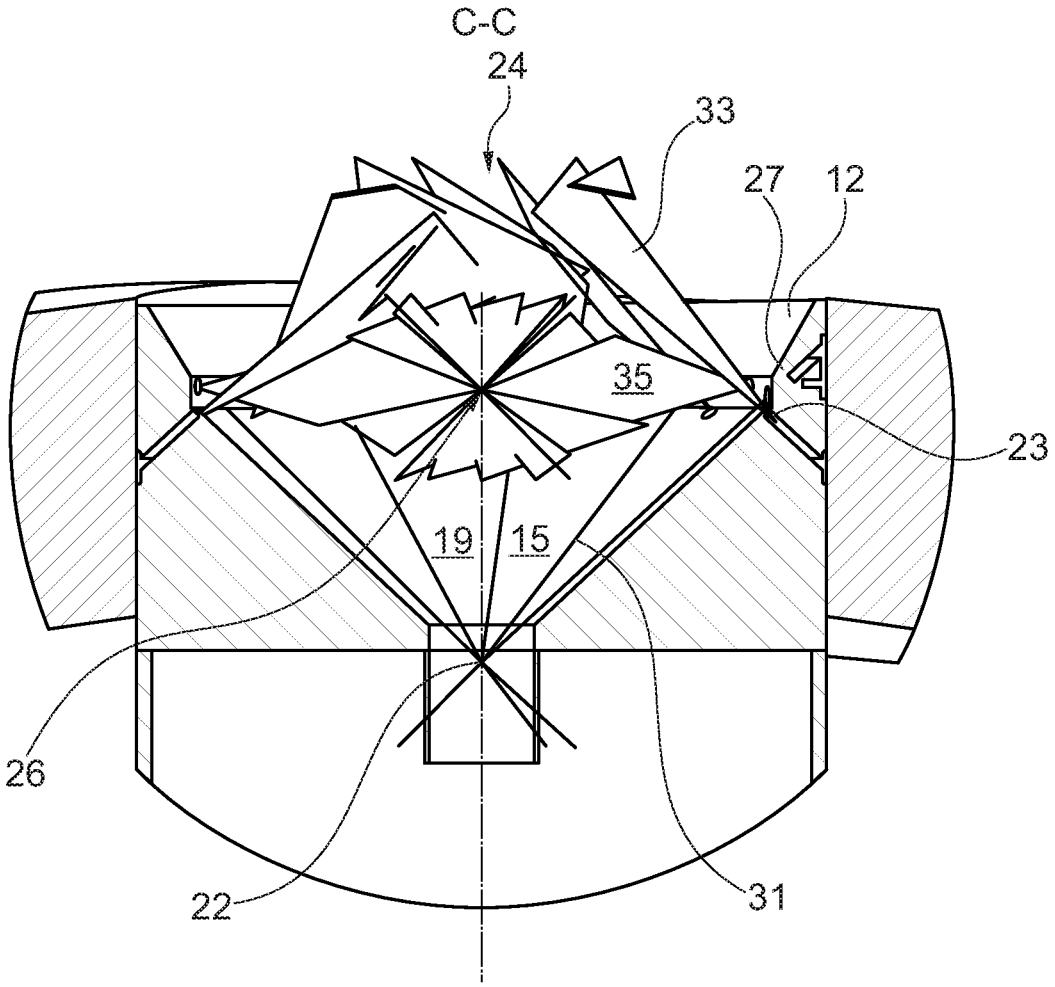
Figure 5:
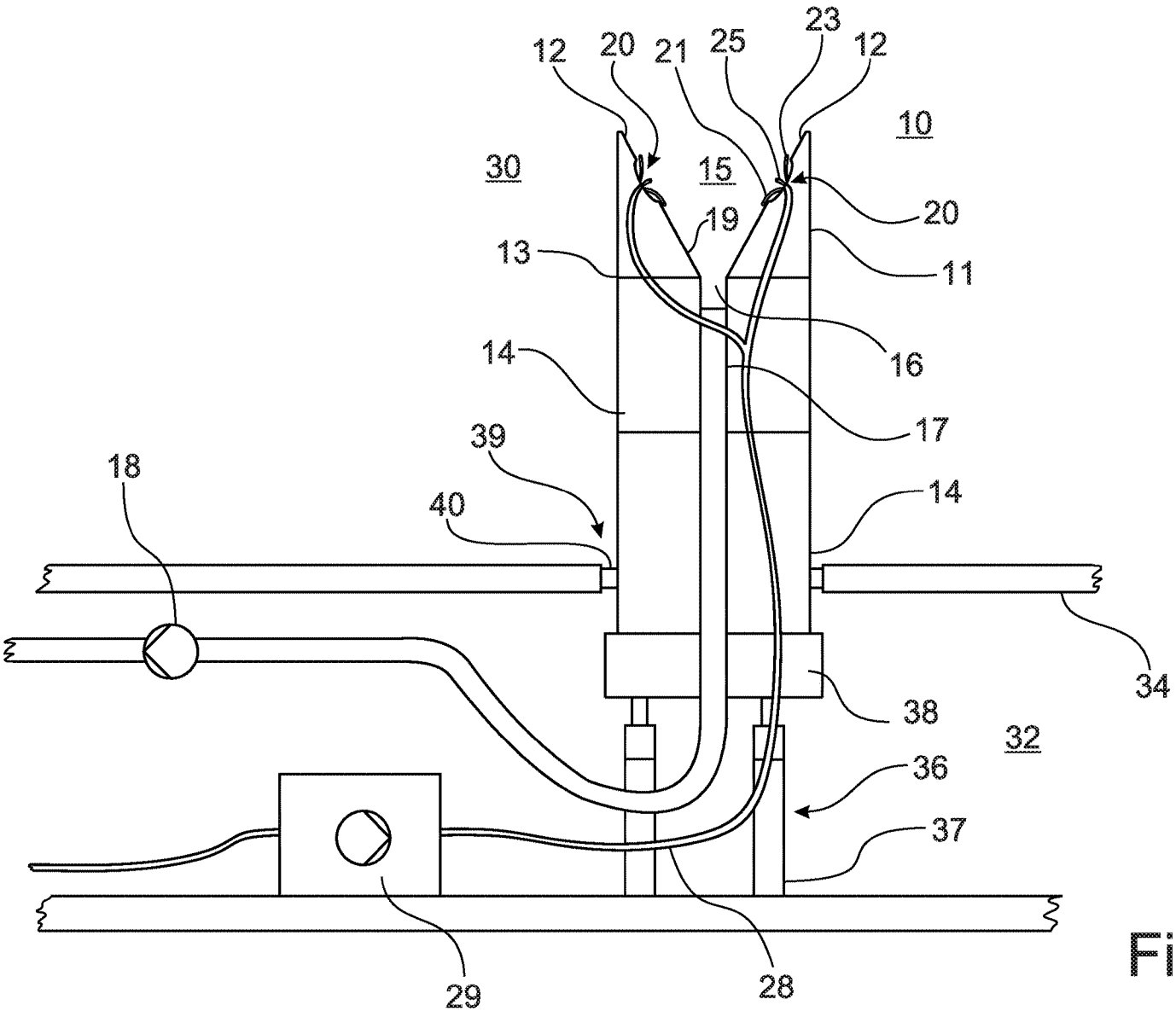

The invention is explained in more detail in the following text by way of an exemplary embodiment in conjunction with a drawing, in which:

FIG. 1*a* shows a plan view of an apparatus according to the invention,

FIG. 1*b* shows an alternative illustration with illustrated liquid jets analogous to FIG. 1*a*, FIG. 2*a* shows a section al view of FIG. 1*a* on the section line D, FIG. 2*b* shows a further illustration as in FIG. 2*a* with illustrated liquid jets from the first nozzles, FIG. 2*c* shows a further view as in FIG. 2*a* with all of the liquid jets, FIG. 3*a* shows a sectional view on the section line B in FIG. 1*a*, FIG. 3*b* shows a supplementary illustration to FIG. 3*a* with liquid jets from the second nozzles, FIG. 3*c* shows a further illustration as in FIG. 3*a* with all of the liquid jets, FIG. 4*a* shows a sectional view on the section line C in FIG. 1*a*, FIG. 4*b* shows a further view as in FIG. 4*a* with liquid jets from the third nozzles, FIG. 4*c* shows a further view as in FIG. 4*a* with all of the liquid jets, and FIG. 5 shows a schematic illustration of a driving system having an apparatus according to the invention.

The figures show an apparatus 10 having a driving head 11, at the outer end of which a cutting element 12 for breaking up the ground is provided; on the opposite side, the driving head 11 has a connection 13 for a support system 14, which may consist of jacking pipes, tunnel segments, pipe segments or pipelines. The driving head 11 has a receiving space 15 that is embodied in a conical manner. Alternatively, other shapes, for example cylindrical or part-conical, are possible. At the upper end, the receiving space 15 is connected to the cutting element 12. At its lower end, at the conical center, the receiving space 15 has an opening 16, to which a discharging line 17 is connected. It is possible for a pump 18 to be provided in the discharging line 17 in order to discharge the mixture of released ground and liquid.

Provided in the inner face 19, embodied here in a partially conical manner, of the receiving space 15 is a recess 20, which extends horizontally in a circle around the entire cone. Alternatively, it is possible for individual recesses to be provided at different points of the cone here. Provided in the recess 20 are a plurality of first nozzles 21, which are arranged such that the liquid jet 31 delivered by the nozzle 21 extends substantially parallel to the conical inner face 19. Advantageously, the nozzles are oriented here such that these jets meet at a point 22 in the opening 16. As a result of this advantageous configuration, it is possible to reduce into small pieces the broken-up ground located in this region of the receiving space 15, unless this has already occurred, and simultaneously to move it along the inner face 19 toward the opening 16.

Furthermore, a plurality of second nozzles 23 are provided in the recess 20, which are arranged such that the liquid jet 33 delivered thereby is directed toward the cutting element 12. Advantageously, the nozzles 23 are provided in this case such that the jets 33 meet in a region 24 located outside the driving head 11 in the ground. These jets 33 effect a kind of collapse in the ground in the region 24, into which the ground broken up and displaced by the cutting element 12 can then move. As a result, the breaking up and transporting away of the ground by the driving head 11 is made easier, in particular in the case of cohesive ground.

Furthermore, third nozzles 25 are arranged in the recess 20, which are directed substantially toward the opposite inner face 19 of the receiving space 15. Advantageously, they are provided in this case substantially at right angles, such that the jets 35 thereof meet in a region 26. This region is located preferably at the height of the transition region 27 between the cutting element 12 and receiving space 15. As a result of the provision of the third nozzles, in the region 26 the entering ground is reduced into small pieces and broken up by the liquid jets 35.

The nozzles 21, 23, 25 are connected to a feed line 28, in which a pump 29 is provided. Via the feed line 28, the liquid to be delivered via the nozzles 21, 23, 25 is fed.

FIG. 1*a* shows a plan view of the apparatus 10 according to the invention. Visible here are the driving head 11, with the cutting unit 12 and the receiving space 15. Provided in the middle of the receiving space 15 is the opening 16. Also shown is the recess 20 with the second nozzles 23. FIG. 1*b* shows an alternative view to FIG. 1*a* with the respective liquid jets 31, 33, 35 delivered by the nozzles 21, 23, 25. In this case, the first nozzle 21 delivers a liquid jet 31 as a full jet or point jet. The second nozzle 23 delivers a flat jet 33. The third nozzle likewise delivers a liquid jet 35, which is likewise preferably a flat jet here. Also illustrated in the figures FIG. 1*a* and FIG. 1*b* are the section planes B-B, C-C and D-D. The section plane B-B is illustrated in FIGS. 3*a* to 3*c*. The section plane C-C is illustrated in FIGS. 4*a* to 4*c* and the section plane D-D is illustrated in FIGS. 2*a* to 2*c*.

The section plane C-C is in this case chosen such that it shows a section through two nozzles of the second nozzles 23. The section plane D-D is in this case chosen such that it shows a section through two nozzles of the third nozzles 25. The section plane B-B is in this case chosen such that it shows a section through two first nozzles 21. FIGS. 2*a*, 3*a* and 4*a* in this case each show the section through the driving head 11 according to the invention without illustrating the respective liquid jets 31, 33, 35. FIGS. 2*b*, 3*b*, 4*b* in this case each show the section through the driving head 11 according to the invention with the respective liquid jet 31, 33, 35 of the respective nozzles in section. FIGS. 2*c*, 3*c*, 4*c* show the respective section through the driving head 11 according to the invention with the liquid jets 31, 33, 35 of all the nozzles.

FIG. 5 shows the apparatus 10 according to the invention during the creation of a cavity in the ground 30. In the process, the cavity (not illustrated) is excavated from a section 32, alternatively also from a starting shaft or the like. The section 32 is provided with a tunnel support system 34. Provided in the section 32 is a schematically illustrated press frame 36 with a hydraulic cylinder 37 and an advancing plate 38.

Through an opening 39 in the tunnel support system 34, the cavity is excavated. For this purpose, pipe sections 14 are provided, at the front end of which the driving head 11 is arranged. The opening 39 is sealed off between the tunnel support system 34 and corresponding pipe section 14 via a seal 40. The excavation itself takes place using the known jacking method.

Depending on the condition of the ground, the granular soil can be broken up by the cutter 12 in conjunction with a liquid jet 31 from the nozzle 21 and discharged. If the cohesion of the ground increases, the second nozzle row 23 can additionally be selected in order to improve the process of breaking up the ground and/or the third nozzle row 25 can be selected in order in this case to then simplify the reduction of the ground into small pieces and the breaking up of the ground.

LIST OF REFERENCE SIGNS

10 Apparatus
11 Driving head
12 Cutting element
13 Connection
14 Support system
15 Receiving space
16 Opening
17 Discharging line
18 Pump
19 Inner face
20 Recess
21 First nozzle
22 Point
23 Second nozzle
24 Region
25 Third nozzle
26 Region
27 Transition region
28 Feed line
29 Pump
30 Ground

31 Liquid jet of the first nozzle
32 Section
33 Liquid jet of the second nozzle
34 Tunnel Support system
35 Liquid jet of the third nozzle
36 Press frame
37 Hydraulic cylinder
38 Advancing plate
39 Opening
40 Seal

The invention claimed is:

1. An apparatus for creating a cavity in the ground from a starting point to a target point along a boring line for the introduction of a support system for keeping the cavity open; comprising a driving head and an advancing device, the driving head, comprising:

at the driving head outer end at least one cutting element configured to break up the ground disposed at the outer end of the driving head, a receiving space with an opening to which a discharging line is connected, at least two first nozzles configured to deliver a liquid for transporting away the broken-up ground from the receiving space, said nozzles including delivery openings oriented in the direction of the opening connected to the discharging line, and;

at least two second nozzles comprising delivery openings directed toward the ground to be broken up;

at least two third nozzles, wherein their delivery openings are directed toward an opposite wall of the receiving space;

wherein the at least two first nozzles of the first nozzles are oriented whereby the liquid jets delivered by the first nozzles intersect at a point in the region of the opening, and wherein the second nozzles are oriented whereby the liquid jets delivered by the second nozzles intersect in a region ahead of the cutter and the at least two third nozzles are disposed in the receiving space at right angles to the driving direction.

2. The apparatus as claimed in claim 1, wherein the at least two third nozzles are oriented whereby the liquid jets delivered by the third nozzles intersect in a region in the interior of the receiving space.

3. The apparatus as claimed claim 1 wherein the receiving space is conical.

4. The apparatus as claimed claim 1 wherein the at least two first nozzles are configured to deliver a liquid jet parallel to the surface of the receiving space.

5. The apparatus as claimed claim 1 wherein the apparatus is an apparatus for vertically creating a cavity.

6. The apparatus as claimed in claim 1 wherein at least one of the at least two first or the at least two second nozzles are disposed on a wall of the receiving space.

7. The apparatus as claimed in claim 1 wherein at least one of the at least two first, the at least two second or the at least two third nozzles are disposed on a wall of the receiving space.

8. The apparatus as claimed claim 1 wherein at least one of the at least two first, or the at least two second nozzles are selectable separately.

9. The apparatus as claimed claim 1 wherein at least one of the at least two first or the at least two second nozzles are full jet nozzles.

10. The apparatus as claimed claim 1 wherein at least one of the at least two first or the at least two second nozzles are flat jet nozzles.

11. An apparatus for creating a cavity in the ground from a starting point to a target point along a boring line for the introduction of a support system for keeping the cavity open;

comprising a driving head and an advancing device, the driving head, comprising:

at the driving head outer end at least one cutting element configured to break up the ground disposed at the outer end of the driving head, a receiving space with an opening to which a discharging line is connected, at least two first nozzles configured to deliver a liquid for transporting away the broken-up ground from the receiving space, said nozzles including delivery openings oriented in the direction of the opening connected to the discharging line, and;

at least two second nozzles comprising delivery openings directed toward the ground to be broken up;

wherein the at least two first nozzles of the first nozzles are oriented whereby the liquid jets delivered by the first nozzles intersect at a point in the region of the opening, and wherein the second nozzles are oriented whereby the liquid jets delivered by the second nozzles intersect in a region ahead of the cutter and wherein the cavity is created vertically upwards.

12. The apparatus as claimed in claim 11, comprising at least two third nozzles, wherein their delivery openings are directed toward an opposite wall of the receiving space.

13. The apparatus as claimed in claim 12, wherein the at least two third nozzles are oriented whereby the liquid jets delivered by the third nozzles intersect in a region in the interior of the receiving space.

14. The apparatus as claimed in claim 13 wherein the at least two third nozzles are disposed in the receiving space at right angles to the driving direction.

15. The apparatus as claimed claim 11 wherein the receiving space is conical.

16. The apparatus as claimed claim 11 wherein the at least two first nozzles are configured to deliver a liquid jet parallel to the surface of the receiving space.

17. The apparatus as claimed in claim 11 wherein at least one of the at least two first or the at least two second nozzles are disposed on a wall of the receiving space.

18. The apparatus as claimed claim 11 wherein at least one of the at least two first, or the at least two second nozzles are selectable separately.

19. The apparatus as claimed claim 11 wherein at least one of the at least two first or the at least two second nozzles are full jet nozzles.

20. The apparatus as claimed claim 11 wherein at least one of the at least two first or the at least two second nozzles are flat jet nozzles.

* * * * *